US005319928A

United States Patent [19]

Bone et al.

[11] Patent Number: 5,319,928

[45] Date of Patent: Jun. 14, 1994

[54] METHOD AND ARRANGEMENT FOR CONTROLLING THE OPERATION OF A SECONDARY AIR PUMP

[75] Inventors: Rainer Bone, Oberriexingen; Jög Lange, Eberdingen-Hochdorf; Winfried Moser, Ludwigsburg, all of Fed. Rep. of Germany

[73] Assignee: Robert Bosch GmbH, Stuttgart, Fed. Rep. of Germany

[21] Appl. No.: 993,004

[22] Filed: Dec. 18, 1992

[30] Foreign Application Priority Data

Dec. 19, 1991 [DE] Fed. Rep. of Germany ..... 4141946

[51] Int. Cl.[5] ..... F01N 3/22

[52] U.S. Cl. ..... 60/274; 60/284

[58] Field of Search ..... 60/274, 284, 289, 290

[56] References Cited

U.S. PATENT DOCUMENTS

| | | | |
|---|---|---|---|
| 3,657,893 | 4/1972 | Tadokoro et al. | 60/289 |
| 3,986,352 | 10/1976 | Casey | 60/284 |
| 4,189,915 | 2/1980 | Miura | 60/290 |
| 4,200,071 | 4/1980 | Maurer et al. | 60/290 |
| 4,450,680 | 5/1984 | Otsuka et al. | 60/274 |
| 4,464,896 | 8/1964 | Kubota | 60/284 |
| 5,136,842 | 8/1992 | Achleitner et al. | 60/290 |

OTHER PUBLICATIONS

"Die Abgasreinigung der neuen Mercedes-Benz 300 SL-24 und 500 SL-Aufbau und Wirkungsweise", by W. Zahn et al. MTZ Motortechnische Zeitschrift 50 Dec. (1989) 6, p. 249.

*Primary Examiner*—Tony M. Argenbright
*Assistant Examiner*—M. Macy
*Attorney, Agent, or Firm*—Walter Ottesen

[57] ABSTRACT

The emission of toxic materials when starting an internal combustion engine equipped with a catalytic converter and a secondary air pump can be further reduced with the method and arrangement of the invention. This reduction takes place by a switch-on of the secondary air pump under selectable conditions which include a warm start of the engine. The danger of overheating the catalytic converter by the operation of the secondary air pump for a warm engine is taken into account by a variable switch-on duration of the secondary air pump which can be realized by a counting procedure having an increment dependent on operating parameters.

12 Claims, 3 Drawing Sheets

METHOD AND ARRANGEMENT FOR CONTROLLING THE OPERATION OF A SECONDARY AIR PUMP

FIELD OF THE INVENTION

The invention relates to a system for supplying secondary air to the exhaust gas of an internal combustion engine equipped with a lambda control and a catalytic converter.

BACKGROUND OF THE INVENTION

The utilization of secondary air pumps in combination with lambda control processes and catalytic exhaust gas purification is disclosed, for example, in U.S. Pat. No. 4,200,071. In contrast to conventional lambda control systems, the control intervention in the method disclosed in this patent does not operate on the fuel-metering signal, rather, on the air quantity. This takes place by selectively supplying secondary air at the intake end to the precontrolled operating mixture which is slightly rich or by supplying the secondary air at the exhaust gas end to the combustion products of this slightly rich preadjusted mixture. In both cases, an oxygen concentration in the exhaust gas is to be obtained which corresponds to the lambda value of 1 as it is desired for the optimal toxic material conversion in the three-way catalytic converter arranged downstream. For this purpose, it is necessary to maintain the supply of secondary air in at least large portions of the operating phases of the internal combustion engine. This continuous operation is however not desirable because of the noise level and the service life of the secondary air pump.

The lambda control acts primarily on the fuel-metering signal in more modern systems equipped with secondary air pumps. The secondary air pump operates there only in the relatively short time interval of the warm-up phase after a cold start wherein the lambda control is not yet operationally ready. The exothermal reaction of the air, which is blown in between the outlet valves of the engine and the catalytic converter, and the hot exhaust gases and the further oxidation in the catalytic converter lead to an accelerated warm-up of the catalytic converter. The secondary air pump is switched off with the start of the lambda control. One such system is described, for example, in the publication "MTZ" (Motortechnische Zeitschrift), Volume 50 (1989), Number 6, page 249.

The systems operating in accordance with the last-described method however do still have disadvantages. Increased exhaust-gas emissions can occur especially with the restart of an engine, which is still warm, because the temperature of the catalytic converter can drop off rapidly below its operating temperature during an interruption of the engine operation. On the other hand, the danger is present for a warm engine that an operation of the secondary air pump leads rapidly to overheating and therefore to damage of the catalytic converter.

SUMMARY OF THE INVENTION

It is an object of the invention to provide a method and an arrangement wherein the emission of unwanted exhaust-gas components is reduced at the start of an engine which is still operationally warm.

The method of the invention is for open-loop controlling the supply of secondary air from a secondary air pump to the exhaust gas of an internal combustion engine equipped with a lambda control modulating a fuel-metering signal and a catalytic converter. The method includes the step of switching on the secondary air pump for selectable conditions which include a warm start of the engine.

The advantage of the method of the invention is a reduction in the emission of toxic materials after a start of an engine which is still warm. Another advantage of the invention is that a thermal overload of the catalytic converter can be prevented by a timely shutoff of the secondary air pump. The pump noise is caused to start only after the engine is running by the delayed switch-on of the secondary air pump. For an electrically operated secondary air pump, the current necessary to operating the pump must not be made available in advance of or during the starting operation. The use of a mechanically driven pump is also conceivable in addition to the use of an electrically-driven pump. The terms "switch-on" or "switch-off" characterize in this case the switching of a coupling between the secondary air pump and the drive thereof.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
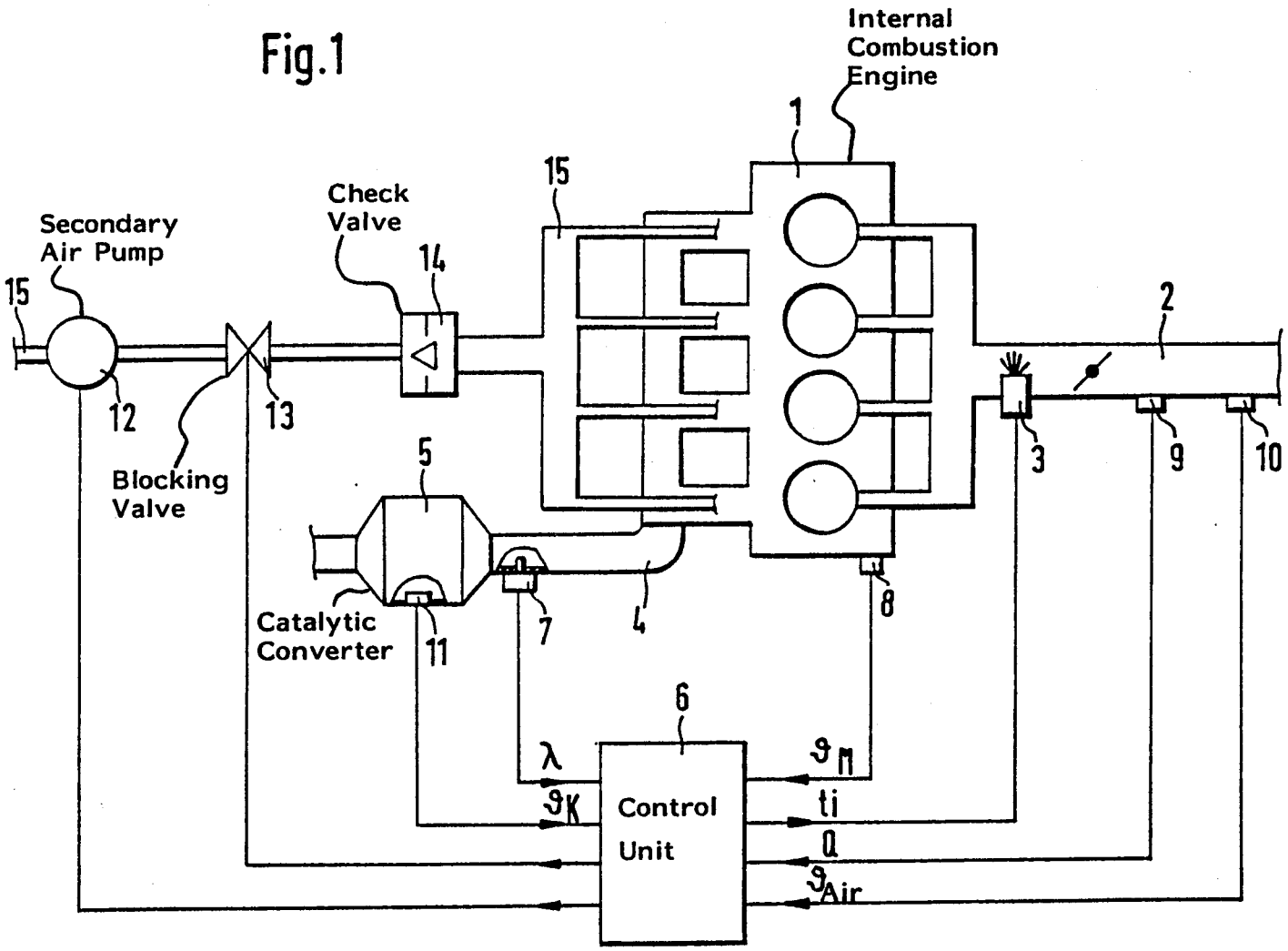
FIG. 1 is a schematic of an arrangement of the invention for controlling the supply of secondary air to the exhaust gas of an internal combustion engine.

Referring to FIG. 1, an internal combustion engine 1 is supplied with an air/fuel mixture from the intake pipe 2 in combination with a fuel-metering device 3. The exhaust gases arising during the combustion collect in an exhaust-gas pipe 4 and are purified in a catalytic converter 5. A control unit 6 receives signals of a lambda probe 7 as well as signals of additional sensors such as signals from a sensor 8 for the temperature of the coolant of the engine, a sensor 9 which indicates the load condition of the engine, a sensor 10 for the temperature of the intake air and a sensor 11 for the temperature of the catalytic converter. These sensors are exchangeable with each other in part as to their functions and therefore can be used in part alternatively to each other or can be deleted when carrying out the method of the invention. In addition to the signals of the sensors, the control unit 6 receives still further signals from sensors (not shown) such as signals indicative of the engine speed.

The supply of secondary air to the exhaust gas of the engine is controlled via an output of the control unit 6 by means of a conduit system 15. A further output is provided for driving the fuel-metering device 3 which, for example, can be driven by an injection pulse width signal ti. At least one secondary air pump 12 is provided in the conduit system 15. In addition, a blocking valve 13 and a check valve 14 can be integrated into the conduit system 15. The control of the secondary air quantity can, for example, take place by means of one or a combination of the following measures: influencing the rotational speed of the secondary air pump 12 and influencing the cross-sectional opening of the blocking valve 13.

The logic combination of the input signals in the control unit 6 to provide the method of the invention is explained with reference to the flowchart of FIG. 2. The start of the engine can be detected, for example, when a threshold value for the engine speed is exceeded. After the start of the engine (step s1), an inquiry step s2 follows after passing a mark A and, in this step s2, a check is made as to whether a pregiven time span tev has passed since the start of the engine. Only when this condition is satisfied, a step s3 follows after the mark B with this step symbolizing the switch-on of the secondary air pump.

In a preferred embodiment of the invention, a comparison of the counter position (z) to a maximum value zmax takes place within a comparison step s4 after mark C. As long as (z) has not reached the value zmax, then an increase of this counter position by the value x takes place in a step s5. When z=zmax in step s4, the switch-off of the secondary air pump takes place in a step s6 after passing the mark D and a transition follows to normal operation without the supply of secondary air to the exhaust gas.

The time delay provided by step s2 ensures that the noise associated with the operation of the secondary air pump only starts when the engine is running and that no additional load on the current supply takes place during the start of the engine for a secondary air pump which is driven electrically.

Figure 3:
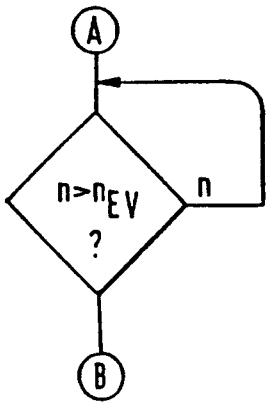
FIG. 3 is a schematic of a wait loop which can be interposed between marks A and B of the flowchart of FIG. 2.

As an alternative to the time threshold, the use of a load or engine-speed threshold can be purposeful for delaying switch-on. A wait loop is shown in FIG. 3 as exemplary for both alternatives. In this wait loop, the engine speed (n) is interrogated between marks A and B until the speed (n) reaches the threshold value nev.

Figure 4:
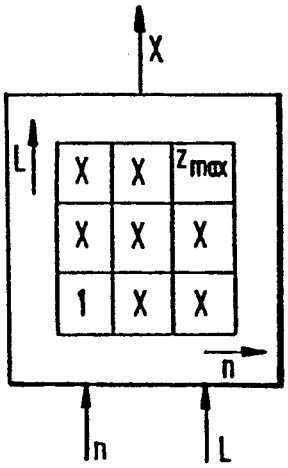
FIG. 4 is a schematic representation of a characteristic field for use in association with step s4 of FIG. 2; and, FIGS. 5*a* to 5*e* show subprograms which can be substituted between marks C and D in the method step sequence of FIG. 2.

The subprogram lying between the marks C and D is intended to ensure that the secondary air pump remains in operation only so long as it is necessary for an accelerated heat up of the catalytic converter because a switch-on duration which is too great brings with it the danger of permanent damage of the catalytic converter by overheating. The speed of heat-up increases with increasing exhaust-gas quantity per unit of time, that is, with increasing load and increasing engine speed. For this reason, it is advantageous to vary the switch-on duration in dependence upon the load response and engine speed response during this time span. According to a preferred embodiment of the invention, this is obtained by means of a variable increment (x) in step s5 of FIG. 2. This increment (x) is dependent upon the load and speed of the engine. As shown in FIG. 4, a characteristic field can, for example, be used wherein different increments can be stored which are addressable via load and engine speed. The values of the increments increase from left-bottom to right-top. The amount of the counter increment is advantageously selected to be proportional to the injected quantity of fuel which is given, for example, by the injection pulse width ti. Furthermore, it is purposeful to increase the counter position (z) synchronously to the speed of the engine, for example, after each revolution. It can be advantageous to store the value zmax for one or more operating states wherein the danger to the catalytic converter of overheating is especially great. In this case, the condition z<zmax checked in the step s4 of FIG. 2 is not satisfied with the consequence that an immediate switch-off of the secondary air pump follows in step s6. The configuration of FIG. 4 ensures an immediate switch-off of the secondary air pump for a combination of full load and high engine speed.

Figure 5A:
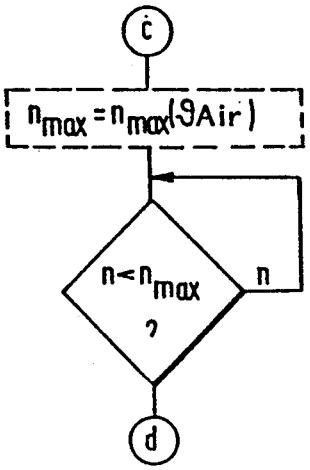
Figure 5B:
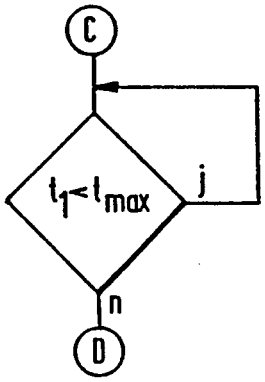
Figure 5C:
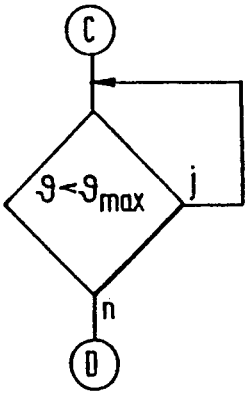
Figure 5D:
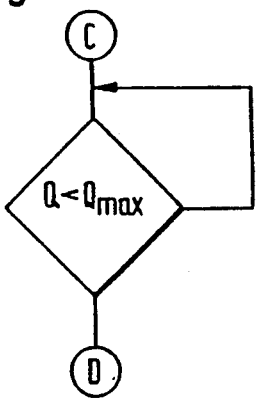
Figure 5E:
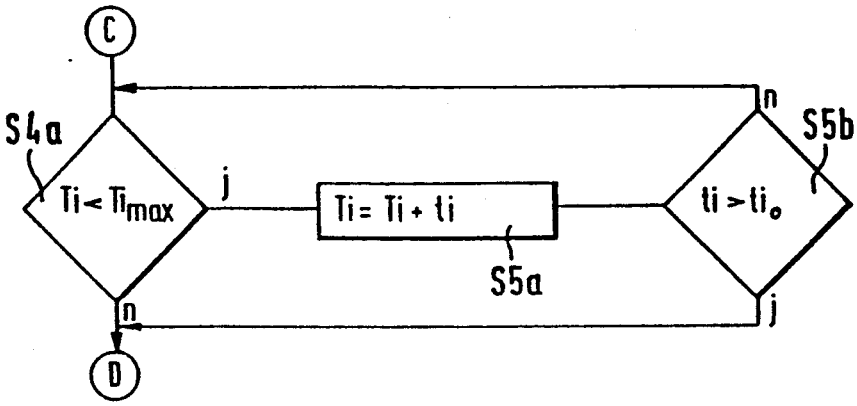

As an alternative to this method sequence, the subprogram (FIG. 2) lying between the marks C and D can also be substituted by the embodiments shown in FIGS. 5*a* to 5*e*. According to FIG. 5*a*, a switch-off of the secondary air pump takes place when a predetermined maximum speed nmax is exceeded. FIG. 5*b* defines the possibility of a switch-off of the secondary air pump after a time threshold tmax has run with the variable $t_1$, which is to be repeatedly interrogated, having the value zero at the start of the operation of the secondary air pump. FIG. 5*c* shows a loop having a temperature comparison. The variable $\nu$ can characterize values of the engine temperature (sensor 8 in FIG. 1) as well as values of the catalytic-converter temperature (sensor 11 in FIG. 1). FIG. 5*e* shows a pregiven load threshold value Qmax. The secondary air pump is switched off when this load-threshold value is exceeded by the load variable Q (sensor 9). The switch-off of the secondary air pump can also take place via a full-load switch in systems having this switch.

Figure 2:
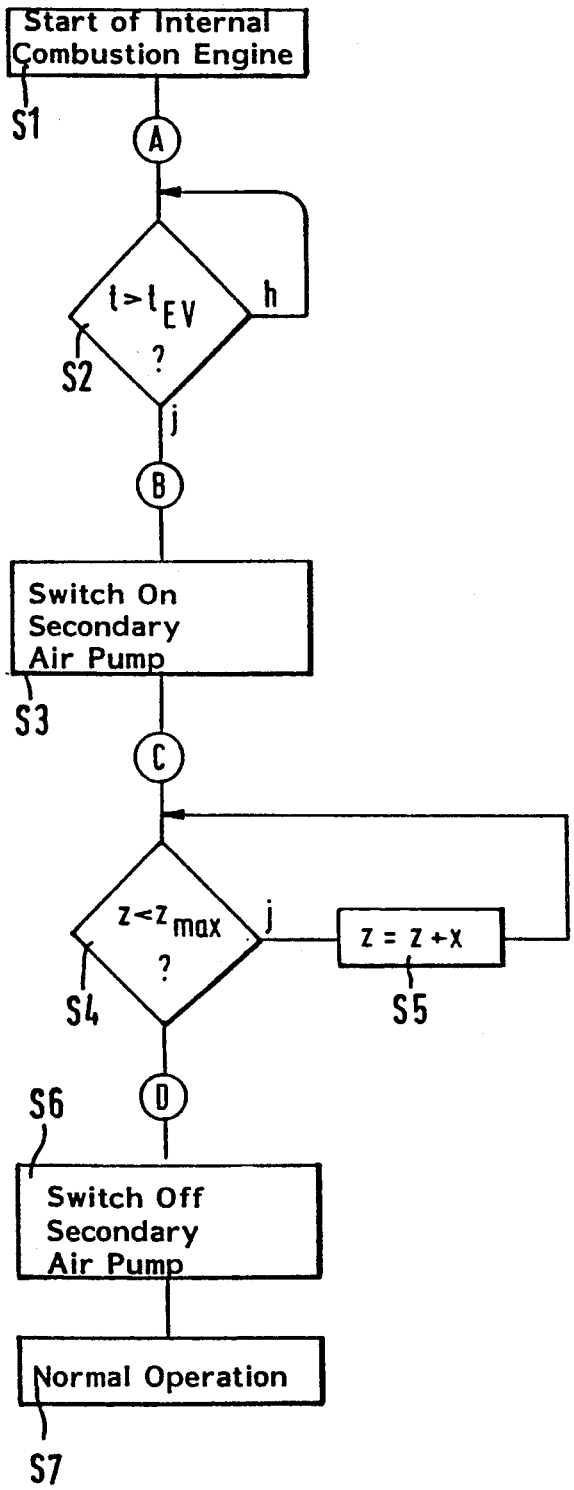
FIG. 2 is a flowchart showing the sequence of the steps of the method of the invention.

In the embodiment of FIG. 5*e*, the running time of the secondary air pump is configured in dependence upon the time trace of the operating parameters of the engine in a similar manner as in the embodiment of FIG. 2. For this purpose, the value Ti is compared to a maximum value Ti-max in a step s4*a*. Ti can, for example, be proportional to the entire quantity of fuel injected since the start of the secondary air pump or since the start of the engine. The sum of all individual injection pulses ti supplies, for example, the desired proportionality. As long as the threshold value Ti-max is not 5 exceeded, a step s5*a* follows the Ti-comparison. In step s5*a*, the current injection value ti is added in synchronism with the rotational speed to the present value of the sum Ti. To ensure that the catalytic converter does not undergo any overheating during full-load operation, a further comparison step s5*b* is provided wherein a switch-off of the secondary air pump is provided as soon as the current injection value Ti exceeds a threshold value characteristic for high-load conditions. The switch-off is also then triggered when the sum value Ti exceeds its maximum value Ti-max in the inquiry in step s4*a*. In a manner similar to the embodiment of FIG. 2, a counting procedure is carried out in the same way as with the embodiment of FIG. 2. Counting steps preferably take place in synchronism to the engine speed and the counter increment is preferably proportional to the particular injected fuel quantity.

The predetermined maximum values for engine speed, time, temperature and load mentioned in the embodiments can also be dependent upon the conditions at the time point of the start of the engine. This applies also to the start and end values for the counting procedure used in the context of the preferred embodiment. For example, for a start with a comparatively cold engine, a higher zmax value (tmax value) is more purposeful than for a comparatively warm engine in order to adapt the running time of the secondary air pump to the heat requirement of the catalytic converter. For comparatively high intake-air temperature (sensor 10) a shortening of the switch-on duration is advantageous. An example for this possibility is the block shown with the broken line in FIG. 5*a* in which the value nmax is determined in dependence upon the intake-air temperature after the mark C.

It is furthermore purposeful to provide an adaptation of the secondary air quantity to the exhaust-gas quantity in order to further reduce the emission of toxic material. This adaptation can take place precontrolled (load, engine speed) as well as closed-loop controlled provided that the lambda control is operationally ready. Corresponding method steps can take place for example in control unit 6. This control unit can be realized as a separate component as well as a component subordinated to a control apparatus with the control apparatus taking over further functions such as the closed-loop/open-loop control of the composition of the fuel/air mixture.

It is understood that the foregoing description is that of the preferred embodiments of the invention and that various changes and modifications may be made thereto without departing from the spirit and scope of the invention as defined in the appended claims.

What is claimed is:

1. A method of controlling the supply of secondary air from a secondary air pump to the exhaust gas of an internal combustion engine equipped with a lambda control modulating a fuel-metering signal and with a catalytic converter, the method comprising the step of: switching on said secondary air pump for selectable conditions which include a warm start of the engine.

2. The method claim 1, wherein the switch-on of said secondary air pump takes place delayed with respect to the start of the engine.

3. The method claim 2, wherein said secondary air pump is switched on only after a predetermined time span has elapsed; and, said time again span begins with the start of the engine.

4. The method claim 2, wherein said secondary air pump is started only after exceeding a threshold value nev of the engine speed (N) for the first time.

5. The method of claim 1, wherein the secondary air pump is switched off when at least one of the following pregiven conditions is satisfied:

(a) the time duration (t) during which the secondary air pump is switched on exceeds a threshold value $t_{max}$;

(b) the load Q of the engine exceeds a threshold value $Q_{max}$;

(c) the rotational speed (n) of the engine exceeds a threshold value $n_{max}$; and (d) the temperature $\theta$ of the engine or the catalytic converter exceeds a threshold value $\theta_{max}$.

6. The method claim 5, wherein the above-mentioned threshold values $t_{max}$, $Q_{max}$, $n_{max}$ and $\theta_{max}$ are dependent upon at least one of the following: the temperature of the intake air and the temperature of the engine at the restart of the engine.

7. A method of open-loop controlling the supply of secondary air from a secondary air pump to the exhaust gas of an internal combustion engine equipped with a lambda control modulating a fuel-metering signal and with a catalytic converter, the method comprising the steps of:

switching on said secondary air pump for selectable conditions which include a warm start of the engine;

determining the switch-on duration of the secondary air pump by the duration of a counting procedure between a predetermined start value and a predetermined end value; and, triggering the counting procedure by the switch-on of said secondary air pump with the increments of the counting steps being dependent on current operating parameters of the engine.

8. The method claim 7, wherein the increments are dependent upon the engine speed, the load or upon a combination of said engine speed and said load.

9. The method claim 7, wherein the increments of the counting steps are proportional to the fuel quantity which is injected during one revolution of the engine; and, the counting steps are carried out in synchronism to the revolutions of the engine.

10. The method claim 7, wherein at least one of the start value and the end value are dependent upon at least one of the temperature of the engine, the temperature of the catalytic converter and the temperature of the intake air at the start of the engine.

11. An arrangement for controlling secondary air to the exhaust gas of an internal combustion engine equipped with a lambda control modulating a fuel-metering signal and with a catalytic converter, the arrangement comprising:

means for supplying the secondary air to the exhaust gases forward of the catalytic converter;

means for switching on said secondary air pump said engine is restarted while said engine is still warm;

means for checking pregiven switch-off conditions indicative of the temperature of the catalytic converter; and means for switching off said secondary air to the exhaust gases thereby preventing said catalytic converter from becoming thermally overloaded.

12. A method of reducing the emission of toxic substances from an internal combustion engine equipped with a lambda control modulating a fuel-metering signal and with a catalytic converter, the engine further including a secondary air pump for supplying secondary air to the exhaust gas of the engine, the method comprising the steps of:

switching on said secondary air pump when said engine is restarted while still warm to produce a supply of secondary air;

directing said supply of secondary air into the exhaust gas upstream of said catalytic converter so as to permit said secondary air and said exhaust gas to undergo an exothermal reaction in said catalytic converter to heat said catalytic converter to reduce the emission of unwanted components of said exhaust gas after the warm engine is restarted; and, timely cutting off the supply of secondary air to prevent said catalytic converter from becoming thermally overloaded.

* * * * *

UNITED STATES PATENT AND TRADEMARK OFFICE

CERTIFICATE OF CORRECTION

PATENT NO. : 5,319,928

DATED : June 14, 1993

INVENTOR(S) : Rainer Bone, Jörg Lange and Winfried Moser

It is certified that error appears in the above-identified patent and that said Letters Patent is hereby corrected as shown below:

Item [75],

On the title page, under "Inventors", line 1: delete "Jög Lange" and substitute -- Jörg Lange -- therefor.

Item [56],

On the title page, under "U.S. Patent Documents", line 6: delete "4,464,896 8/1964 Kubota ... 60/284" and substitute the following therefor: -- 4,464,896 8/1984 Kubota ... 60/284 --.

In column 4, line 22: delete "v" and substitute -- $\nu$ -- therefor.

In column 4, line 41: delete "5".

In column 5, line 39: delete "again".

In column 5, line 43: delete (N) and substitute -- (n) -- therefor.

In column 5, line 53: after "and", insert -- , --.

In column 6, line 35: between "pump" and "said" (second occurrence), insert -- when --.

UNITED STATES PATENT AND TRADEMARK OFFICE

CERTIFICATE OF CORRECTION

PATENT NO. : 5,319,928

DATED : June 14, 1993

INVENTOR(S) : Rainer Bone, Jörg Lange and Winfried Moser

It is certified that error appears in the above-identified patent and that said Letters Patent is hereby corrected as shown below:

In column 6, line 39: after "and", insert -- , --.

Signed and Sealed this

Twenty-fourth Day of January, 1995

*Attest:*

Bruce Lehman

BRUCE LEHMAN

*Attesting Officer*

*Commissioner of Patents and Trademarks*